US006041526A

United States Patent [19]

Collins

[11] Patent Number: 6,041,526

[45] Date of Patent: Mar. 28, 2000

[54] GROUND-GRIPPING ELEMENTS FOR SHOE SOLES

[75] Inventor: David Roy Collins, Sutton Coldfield, United Kingdom

[73] Assignee: Trisport Limited, Staffordshire, United Kingdom

[21] Appl. No.: 09/041,051

[22] Filed: Mar. 10, 1998

Related U.S. Application Data

[60] Provisional application No. 60/040,233, Mar. 11, 1997.

[51] Int. Cl.[7] ..... A43B 5/00

[52] U.S. Cl. ..... 36/127; 36/134

[58] Field of Search ..... 36/127, 134, 67 D, 36/59 C

[56] References Cited

U.S. PATENT DOCUMENTS

| | | | |
|---|---|---|---|
| 4,375,728 | 3/1983 | Dassler . | |
| 5,029,405 | 7/1991 | De Haitre | 36/134 |
| 5,794,367 | 8/1998 | Carroll . | |

FOREIGN PATENT DOCUMENTS

| | | |
|---|---|---|
| 0 524 861 | 1/1993 | European Pat. Off. . |
| 2 053 658 | 2/1981 | United Kingdom . |
| 2 266 223 | 10/1993 | United Kingdom . |
| 2 306 098 | 4/1997 | United Kingdom . |
| 97/14325 | 4/1997 | WIPO . |
| 97/18724 | 5/1997 | WIPO . |

OTHER PUBLICATIONS

The article on p. 149 of Golf Digest, Dec. 1996.

*Primary Examiner*—Ted Kavanaugh

*Attorney, Agent, or Firm*—Schweitzer Cornman Gross & Bondell LLP

[57] ABSTRACT

A moulded plastics golf shoe cleat comprises a disc 14 from an upper surface of which a screw-threaded spigot (not shown) projects for attachment of the cleat to a shoe sole. A ring of barb-forming elements 16 stands on an undersurface 18 of the disc, each element comprising a convergent free-end portion forming a ground-engaging barb which terminates at an edge 24 extending tangentially of the ring. Each barb projects in a direction which makes an acute angle with the undersurface 18 of the disc 14, the barbs being resiliently deflectable to increase the angle whereby resistance to sliding of the cleat in use over penetrable ground may become increased by increased penetration of the barb into the ground. The barbs are aligned along chords to the ring, being uniformly turned out of radial alignment so as to discourage unscrewing of the cleat in use.

18 Claims, 2 Drawing Sheets

GROUND-GRIPPING ELEMENTS FOR SHOE SOLES

Figure 1:
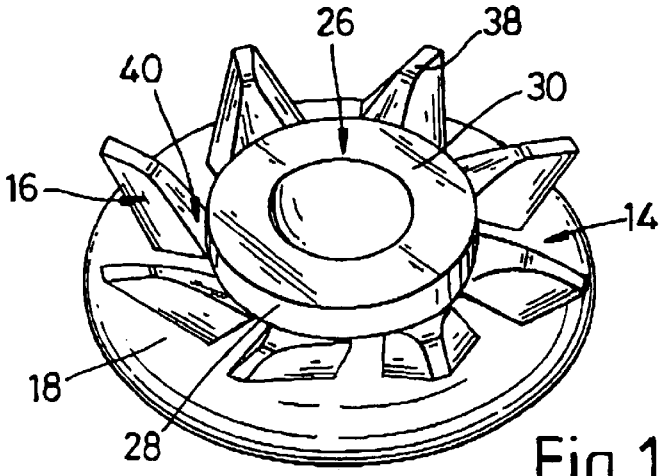

This application claims priority of provisional application Ser. No. 60/040,233, filed Mar. 11, 1997.

This invention relates to the provision of ground-gripping elements on the undersurface of shoe soles, especially sports' shoe soles such as for golf shoes, to improve traction and minimise slipping for a wearer.

There has in recent times been much concern regarding perceived damage done to the greens on golf courses by traditional metal golf spikes (e.g. as described in GB-A-2 028 102) and various alternative forms of less-penetrative cleat (e.g. as described in GB-A-2 266 223 and EP-A-0 524 861) have been proposed. These alternative cleat forms utilise various arrangements of shallow projections, such as ribs and ridges, blocks, cones and pyramids provided in an array over the underside of the cleat, rather than a single relatively long central spike.

In designing a cleat for a golf shoe, or similarly a suitable gripping pattern for the undersurface of a moulded golf shoe sole, there are conflicting requirements to be accommodated: only a totally smooth shoe sole will do no damage to greens, but there will then be a minimum of grip, and conversely it tends to be the case that the greater the grip provided the more widespread the occurrences of damage to the turf. A compromise therefore has to be struck between the requirements of maximum traction and minimum green damage.

There are principally three kinds of damage which commonly occur, which can be referred to as spike marks, indentations and scuffing. Spike marks arise from the use of the traditional long-spiked cleat, the amount of damage which occurs depending upon the length and shape of the spike, the walking action of the golfer and the type and condition of the green. Rightly or wrongly, spike marks have tended to become seen as the worst sort of green damage.

The less-penetrative cleat forms which have become popular avoid making prominent spike marks but can still result in creating unacceptable indentations and scuffing. By an indentation is meant an impression or hollow left in the green by the cleat where a player has been standing, this being determined by the height, shape and profile of the cleat, as well as the type and condition of the green. Scuffing results from a cleat being scraped across the green surface, the damage caused being a function of the maximum height of the projections, the gripping performance of the cleat, the walking action of the golfer and, again, the type and condition of the green.

A further requirement which has to be met is that of durability. Especially with moulded plastics and rubber materials, which are popular with manufacturers in view of their being readily formed into complex patterns and shapes, and popular with users in view of their perceived nonmetallic softness and non-corrosive properties, adequate consideration has to be given to the cleat design (both the design form and the choice of materials) in order to provide a cleat which will continue to function well after a reasonable period of wear. An important design consideration in this respect can be achieving a good balance between the provision of gripping elements for the purposes of achieving traction and the provision of wear faces which can protect the gripping elements by taking some of the standing load. It is important, for durability, to design the cleat so that for as long as possible it continues to perform well as it wears.

It is an object of the present invention to enable ground-gripping formations to be provided on the undersurface of a golf shoe sole which will provide improved tractive performance without causing unacceptable green damage.

The invention provides, in one omits aspects, a replaceable golf shoe cleat comprising:

(i) disc-forming means presenting an upper surface and an undersurface;

(ii) attachment means associated with said upper surface and enabling the cleat to be removably secured to co-operating means of a shoe sole; and (iii) a plurality of barb-forming elements arranged in a ring on said undersurface and each comprising a free-end portion presenting a ground-engaging barb, each barb being aligned to project outwardly of the ring at an acute angle to said undersurface and being resiliently deflectable to increase said angle whereby resistance to sliding of the cleat in use over penetrable ground may become increased by increased penetration of the barb into the ground.

The barb-forming elements may be moulded integrally with said disc-forming means of an elastomer or other resilient material.

In a preferred construction, the barb-forming elements are positioned adjacent to land-forming means which presents wear faces raised from the undersurface. The wear faces and the extremities of the barb-forming elements may be raised the same distance from the undersurface. Alternatively, the wear faces may be raised to a lesser extent than the barb-forming elements in a relaxed condition. In this case, the barbs are also resiliently deflectable towards the undersurface of the sole (so reducing the angle they make with the undersurface) whereby the wear faces are arranged to engage the ground upon a user standing on hard substantially non-penetrable ground, the barbs thereby being protected from severe damage owing to their becoming deflected by the ground to the same level as the wear faces. The land-forming means may comprise individual bodies positioned adjacent to the barb-forming elements, or may comprise, for example, a single body of material positioned within a surrounding array of elements. In a preferred construction, each barb-forming element projects away from an adjacent elongate land-forming body which, for example extending generally in the opposite direction from the barb, may provide a ground-engaging ridge which can further resist slipping of the sole in use.

Each barb-forming element may be of tapering form as viewed in a plane extending through the element at said acute angle to the undersurface of the disc. Preferably it comprises a convergent free-end portion forming a barb which terminates at an edge, the edge extending tangentially of the ring. The free-end portion may present a flat ground-engaging bearing surface extending from the edge in a direction inwardly of the ring, the surface being inclined towards said undersurface in said direction.

The attachment means may be screw-threaded for engagement with screw-threaded co-operating means of a shoe sole. The ring of barb-forming elements may be arranged coaxially of the screw axis, the barbs preferably being aligned along chords to the ring and all turned in the same direction from radial alignment whereby to discourage unscrewing of the cleat.

There now follows a detailed description, to be read with reference to the accompanying drawings, of four constructions of golf shoe cleat which are described to illustrate the invention by way of example.

Figure 2:
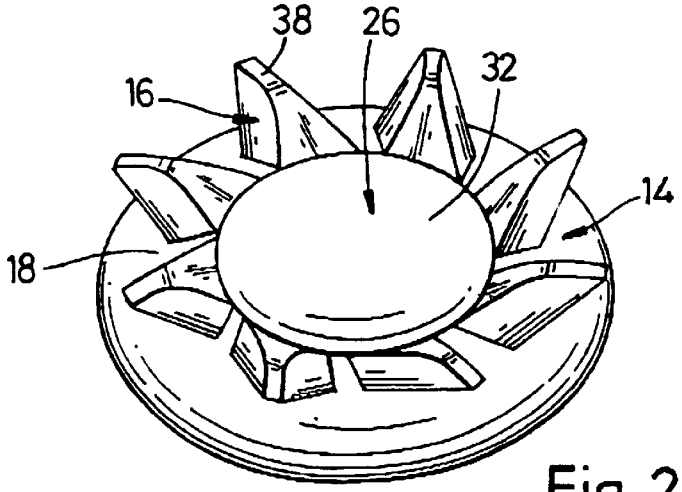
Figure 3:
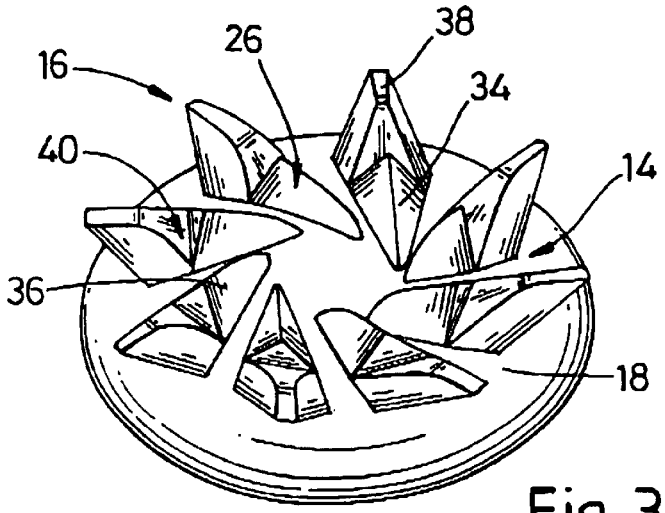
Figure 4:
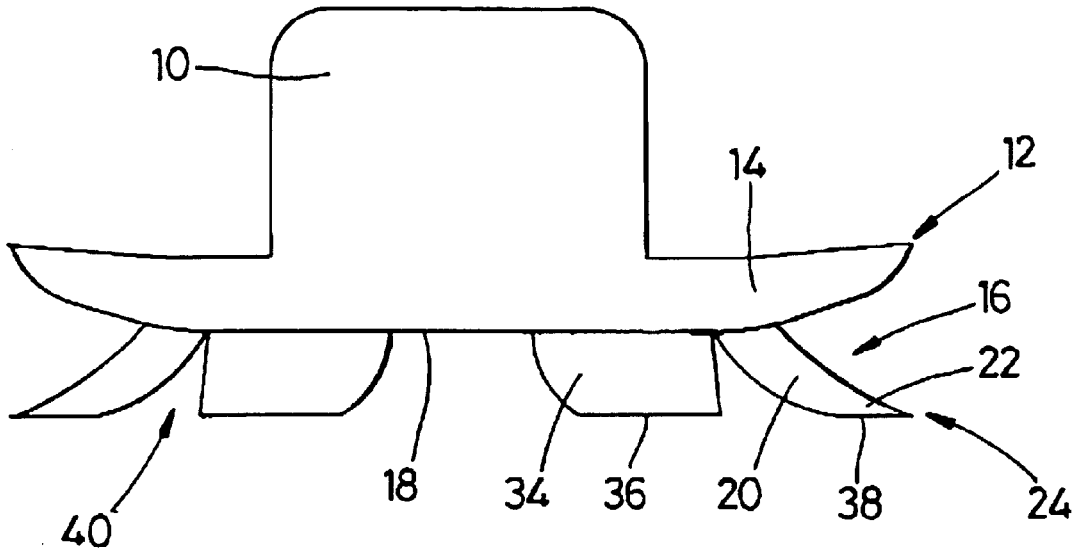

In the accompanying drawings:

FIGS. 1, 2 and 3 are perspective views of three embodiments of the invention; and FIG. 4 is a representation in elevation of a fourth embodiment of the invention, being similar in construction to that of FIG. 3.

FIGS. 1 to 3 show the undersides of three replaceable shoe cleats which are adapted to be removably secured to the undersurface of a golf shoe sole. In a conventional manner, each cleat comprises a screw-threaded spigot 10 (FIG. 4) projecting axially from an upper surface of a disc-forming body 14 and enabling the cleat to be secured in a screw-threaded socket in the sole. The upper surface of the disc 14 comprises a slightly raised peripheral edge 12 so as to engage and seal against the undersurface of the sole. Each cleat may be moulded in one piece of an elastomeric plastics material having sufficient resiliency for the purposes to be described, or may comprise a core of metal or other hard material on to which such plastics material is moulded.

Each cleat presents eight barb-forming elements 16 which stand in a circular ring on an undersurface 18 of the disc 14; in use of the cleat, the undersurface 18 provides a slightly raised continuation of the undersurface of the shoe sole. The eight elements are identical, each comprising a free-end portion presenting a ground-engaging barb 20 which projects in a general direction which makes an acute angle with the undersurface of the disc (and so with the undersurface of the shoe sole in use). The barbs all project outwardly (away from the middle of the cleat) in the direction of chords to the disc, the alignment of each barb being displaced anti-clockwise (as viewed from beneath the cleat) to make an acute angle with the radial direction at its root (as most apparent in FIG. 3). The anti-clockwise inclination of the barbs militates against unscrewing of the cleat in use, the spigot 10 having a right-hand thread so as to become inserted into a sole socket by a clockwise rotation.

Each barb comprises at its free end a convergent portion 22 which terminates at a tip forming an edge 24, the edges of the eight barbs extending tangentially of the ring and lying in a common plane parallel to the disc 14. Also each barb-forming element 16 is of tapering form as viewed in a plane containing the edge 24 and extending through the element at the same acute angle to the undersurface of the disc as the barb.

Each cleat comprises also land-forming means 26 positioned adjacent to the barb-forming elements within the ring of elements. In the construction shown in FIG. 1, the land-forming means comprises a cylindrical boss 28 which extends (in the radial direction) substantially up to the barb-forming elements on the undersurface 18 and which presents at its axial end an annular wear face 30. The cleat shown in FIG. 2 comprises land-forming means which presents a central domed wear face 32.

The form of cleat shown in FIGS. 3 and 4 comprises land-forming means comprising eight individual ridge-forming blocks 34. Each block is of an elongate form and extends substantially from the base of an adjacent barb-forming element 16 in the opposite direction inwardly to the direction of projection outwardly of the barb, the block presenting a wear face in the form of a narrow ridge face 36 at its crest. The ridge face lies in a common plane with a flat crest face 38 of the adjacent barb, the crest face providing a ground-engaging bearing surface. In the construction shown in FIG. 3, the common plane of the two crest faces lies at an acute angle to the plane of the disc 14 (being inclined towards the disc in the inward radial direction). In the construction shown in FIG. 4, the common plane of the two crest faces lies parallel with the plane of the disc. In the former case (FIG. 3) this means that the barbs 20 project further from the undersurface 18 of the disc than do the land-forming blocks 34.

In each of the constructions described, the barbs 20 are resiliently deflectable towards and away from the disc 14. In the case of constructions in which the barbs 20 extend further from the plane of the disc 14 than does the land-forming means 26, the barbs will in use become deflected upwards (towards the disc) by engagement with the ground, allowing the cleat to settle with its wear face or faces engaging the ground in normal standing conditions. In this manner some wear protection is given to the exposed barbs, particularly on hard (non-penetrable) ground. However, on penetrable ground any tendency for lateral movement of the cleat against the ground (corresponding to slipping of the shoe sole over the ground) will be resisted by penetration or increased penetration into the ground of those of the barbs which project generally in the direction of impending movement. The resiliency of the barbs enables them to be deflected away from the disc 14, so temporarily increasing the angle between them and the plane of the disc, which results in greater penetration and greater resistance to slipping. In the case of the constructions of FIGS. 3 and 4, the ridge faces 36 also provide some resistance to slipping.

It is to be noted in the constructions of FIGS. 1, 3 and 4 that the land-forming means 26 can serve a secondary purpose of limiting deflection of the barbs 20 when resisting slipping. Spaces 40 between radially inner surfaces of the barb-forming elements 16 and adjacent outer surfaces of the land-forming means permit unimpeded movement of the barb-forming elements until the surfaces abut with the elements almost upright on the disc 14.

I claim:

1. A replaceable golf shoe cleat comprising:

(i) disc means, said disc means presenting an upper surface and an undersurface;

(ii) attachment means associated with said upper surface and enabling the cleat to be removably secured to co-operating means of a shoe sole;

(iii) a plurality of barb-forming elements arranged in a ring on said undersurface, each barb-forming element being aligned to project outwardly of said ring at an acute angle to said undersurface and including a free end portion presenting a ground-engaging barb, each said barb-forming element being resiliently deflectable to increase said angle between said element and said undersurface for increased penetration of said ground-engaging barb into penetrable ground whereby to increase resistance to sliding of the cleat in use over penetrable ground; and (iv) land means, said land means presenting surfaces raised from said undersurface within said ring of barb-forming elements, said land means comprising a plurality of ridge-forming blocks extending inwardly of the ring from positions adjacent to said barb-forming elements.

2. A cleat according to claim 1, wherein said barb-forming elements are moulded integrally with said disc means of an elastomeric material.

3. A cleat according to claim 1, wherein each said barb-forming element is of tapering form as viewed in a plane extending through said barb at said acute angle to said undersurface.

4. A cleat according to claim 1, wherein each barb-forming element includes a convergent free-end portion forming said barb which terminates at an edge, said edge extending tangentially of said ring.

5. A cleat according to claim 4, wherein each said free-end portion presents a flat ground-engaging bearing surface extending from said edge in a direction inwardly of said ring, said bearing surface being inclined towards said undersurface in said direction.

6. A cleat according to claim 1, wherein said attachment means is screw-threaded for engagement with screw-threaded co-operating means of a shoe sole.

7. A cleat according to claim 6, wherein said ring of barb-forming elements is arranged coaxially of said screw axis.

8. A cleat according to claim 7, wherein said barbs are aligned along chords to said ring, being all turned in the same direction from radial alignment whereby to discourage unscrewing of said cleat in use.

9. A golf shoe including a plurality of cleats according to claim 1.

10. A replaceable golf shoe cleat comprising:

(i) disc means, said disc means presenting an upper surface and an undersurface;

(ii) attachment means associated with said upper surface and enabling the cleat to be removably secured to co-operating means of a shoe sole;

(iii) a plurality of barb-forming elements arranged in a ring on said undersurface, each barb-forming element being aligned to project outwardly of said ring at an acute angle to said undersurface and including a free end portion presenting a ground-engaging barb, each said barb-forming element being resiliently deflectable to increase said angle between said element and said undersurface for increased penetration of said ground-engaging barb into penetrable ground whereby to increase resistance to sliding of the cleat in use over penetrable ground; and (iv) a land means, said land means presenting surfaces raised from said undersurface within said ring of barb-forming elements and in which spaces between radially inner surfaces of said barb-forming elements and adjacent surfaces of said land means permit unimpeded deflection of the barb-forming elements.

11. A cleat according to claim 10, wherein said barb-forming elements are moulded integrally with said disc means of an elastomeric material.

12. A cleat according to claim 10, wherein each said barb-forming element is of tapering form as viewed in a plane extending through said barb at said acute angle to said undersurface.

13. A cleat according to claim 10, wherein each barb-forming element includes a convergent free end portion forming said barb which terminates at an edge, said edge extending tangentially of said ring.

14. A cleat according to claim 13, wherein each said free end portion presents a flat ground-engaging bearing surface extending from said edge in a direction inwardly of said ring, said bearing surface being inclined towards said undersurface in said direction.

15. A cleat according to claim 10, wherein said attachment means is screw-threaded for engagement with screw-threaded co-operating means of a shoe sole.

16. A cleat according to claim 15, wherein said ring of barb-forming elements is arranged coaxially of said screw axis.

17. A cleat according to claim 16, wherein said barbs are aligned along chords to said ring, being all turned in the same direction from radial alignment whereby to discourage unscrewing of said cleat in use.

18. A golf shoe including a plurality of cleats according to claim 10.

* * * * *